US005315846A

United States Patent [19]

Lee

[11] Patent Number: 5,315,846

[45] Date of Patent: May 31, 1994

[54] COOL AIR CIRCULATING APPARATUS FOR A REFRIGERATOR

[75] Inventor: Jae-Seung Lee, Suwon, Rep. of Korea

[73] Assignee: Samsung Electronics Co., Ltd., Suwon, Rep. of Korea

[21] Appl. No.: 12,392

[22] Filed: Feb. 2, 1993

[30] Foreign Application Priority Data

Feb. 24, 1992 [KR] Rep. of Korea ..... 92-2764

[51] Int. Cl.[5] ..... F25D 17/08

[52] U.S. Cl. ..... 62/419; 62/418; 454/286

[58] Field of Search ..... 62/404, 407, 408, 419, 62/418; 454/286, 305

[56] References Cited

U.S. PATENT DOCUMENTS 2,248,983 7/1941 Gleason ..... 62/419
2,279,804 4/1942 Walz ..... 62/419
2,373,741 4/1945 Caldwell ..... 454/305

FOREIGN PATENT DOCUMENTS 1110666 10/1959 Fed. Rep. of Germany ..... 62/419
2-233965 9/1990 Japan .

*Primary Examiner*—Henry A. Bennet
*Assistant Examiner*—William C. Doerrler
*Attorney, Agent, or Firm*—Burns, Doane, Swecker & Mathis

[57] ABSTRACT

A refrigerator has freezing and refrigerating compartments arranged above and below one another. A hollow duct extends vertically through said freezing and refrigerating compartments and receives a flow of cool air at its upper end. The duct includes vertically spaced holes through which the cool air is discharged into the freezing and refrigerating compartments. The duct is freely rotatable about its longitudinal axis and carries fins arranged at the discharge holes such that the discharging cool air impinges against the fins to cause the duct to rotate.

7 Claims, 6 Drawing Sheets

COOL AIR CIRCULATING APPARATUS FOR A REFRIGERATOR

FIELD OF THE INVENTION

The present invention relates to a cool air circulating apparatus for refrigerators.

DESCRIPTION OF THE PRIOR ART

Generally as shown in FIG. 1, a refrigerator body 40 is provided with a separating wall 40*a* by which the interior of the refrigerator is divided into a freezing room 35 and a refrigerating room 38. The separating wall 40*a* is provided with-an eva orator 31 which performs the freezing cycle. The cool air produced by the evaporator 31 is partly supplied through a chill path 34 into the freezing room 35 by the action of a fan 33 which is driven by a motor 32, the chill path 34 being formed through a duct member 41. The rest of the cool air is supplied through a chill path 37 (formed along the top of the refrigerating room 38) into the refrigerating room 38, and in this way, the interior of the refrigerator is freezed and refrigerated.

Then the cool air which is warmed up by the stored foods during the circulation is supplied through chill suction holes 36 and 39 (formed on a side of the separating wall 40*a*) to the evaporator 31, with the result that the cooling of the stored foods is repeated in the form of a circulating action.

However, in this conventional refrigerator, the freezing is done to some degree by supplying the cool air into the freezing room, but the cool air is introduced through the rear side only, with the result that the temperature distribution becomes non-uniform in the freezing room particularly, the cool air is supplied into the refrigerating room only through a chill path which is formed on the top of the refrigerating room, with the result that the cool air is not sufficiently supplied to the lower portion and near the door of the refrigerator, thereby lowering the cooling efficiency, as well as making the distribution of the temperature non-uniform.

In an attempt to give a solution to this problem, Japanese Patent Application Laying-opening No. Hei-2-233965 discloses a refrigerator constituted as shown in FIGS. 2 and 3. This refrigerator includes: a freezing room 51 provided with an evaporator 50 and undergoing a forced ventilating type cooling cycle; a refrigerating room 53 provided with a forced ventilating and intra-chamber agitating type fan 52*a*; a duct 54 passing through the freezing room 51 and the refrigerating room 53, and for sucking the air of the freezing room through the action of the fan 52; a damper thermostat 55 installed upstream of the fan 52 and within the duct 54 in such a manner as to be closed or opened in accordance with the temperature of the refrigerating room 53; and an air path 56 for returning the cool air from the refrigerating room 53 into the freezing room 51.

However, in this conventional refrigerator, the cool air is supplied from the freezing room through a duct into the refrigerating room, with the result that the cooling efficiency is lowered. Particularly, the cool air which is discharged from the duct is directed toward the front portion of the refrigerating room, with the result that the cool air scarcely reaches below the duct, thereby making the temperature distribution non-uniform.

SUMMARY OF THE INVENTION

The present invention is intended to overcome the above described disadvantages of the conventional techniques.

Therefore it is the object of the present invention to provide a cool air circulating apparatus for refrigerators, in which the cool air produced by an evaporator is supplied directly and uniformly to a freezing room and a refrigerating room, so that the cooling efficiency should be improved, and that the temperature distribution should be rendered uniform.

In achieving the above object, the cool air circulating apparatus according to the present invention includes: a refrigerator body surrounded by heat-insulating layers; and a freezing room and a refrigerating room formed within the body, and for being cooled by the cool air through cooling cycles.

The cool air circulating apparatus of the present invention further includes: a chill path formed along a side of the freezing room; a driving motor having a cooling fan within the chill path; a rotary duct communicating with the chill path, and freely rotatably installed through the freezing room and the refrigerating room; and a plurality of cool air discharging holes formed on the circumference of the rotary duct for discharging the cool air into both the freezing room and the refrigerating room.

In the cool air circulating apparatus constituted as above, the circulation of the cool air becomes efficient, and the cool air is supplied uniformly, so that the temperature distribution should become uniform, as well as improving the cooling efficiency.

BRIEF DESCRIPTION OF THE DRAWINGS

The above object and other advantages of the present invention will become more apparent by describing in detail the preferred embodiment of the present invention with reference to the attached drawings in which:

FIGS. 2 and 3 illustrate the internal structure of another conventional refrigerator, in which:

FIG. 2 is a longitudinal sectional view of it; and

FIG. 3 is a sectional view as viewed from the front; and

FIGS. 4 to 6 illustrate the cool air circulating apparatus of the present invention, in which:

FIG. 4 is a longitudinal sectional view of the refrigerator of the present invention;

FIG. 5 is a perspective view of a cool air distributing duct according to the present invention; and FIG. 6 is an enlarged perspective view of the duct depicted in FIG. 5.

DESCRIPTION OF THE PREFERRED EMBODIMENT

The embodiment of the present invention will be described referring to FIGS. 4 to 6.

Figure 1:
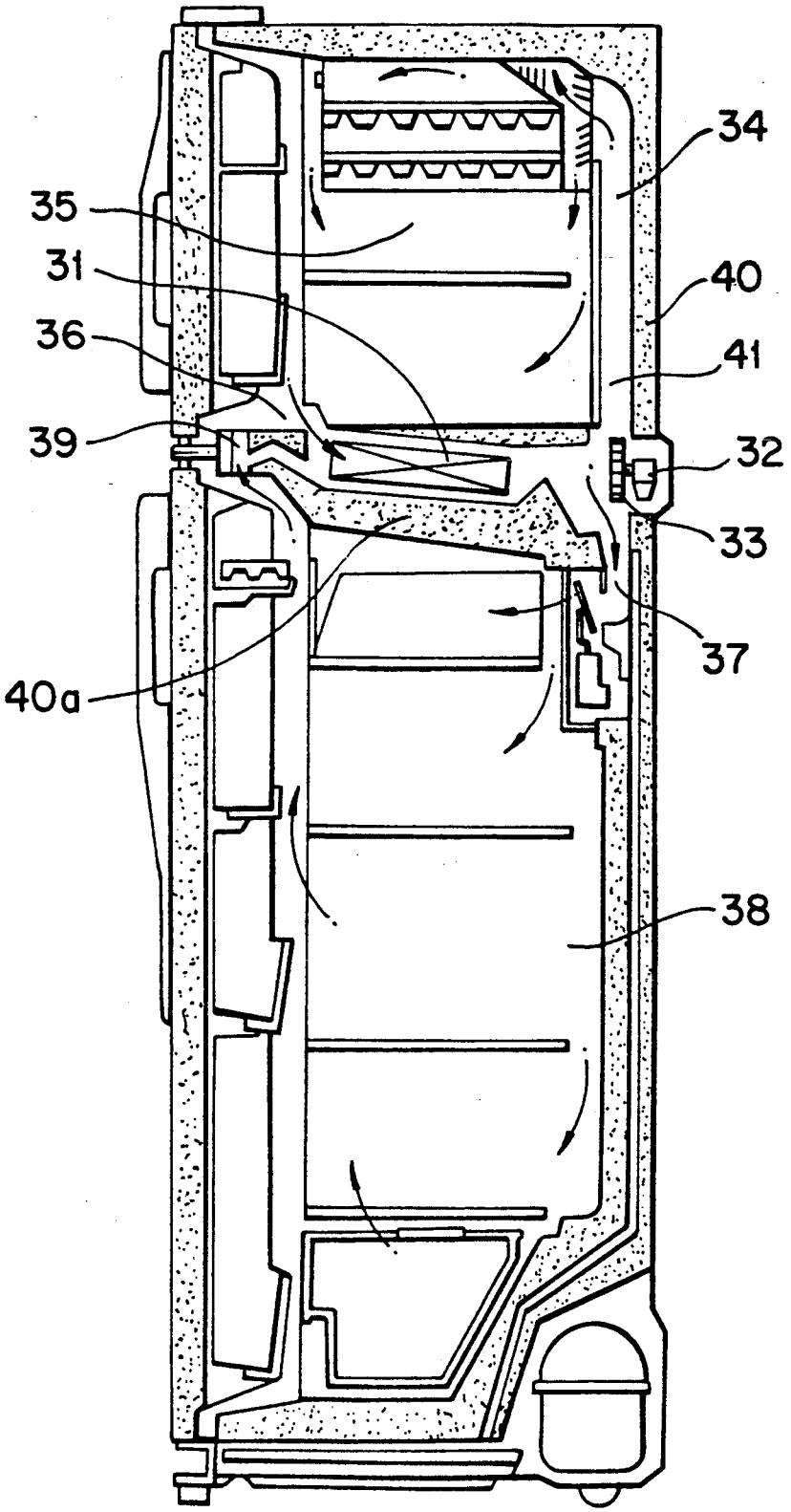
FIG. 1 (PRIOR ART)
FIG. 1 is a longitudinal sectional view showing the internal structure of a conventional refrigerator.
Figure 2:
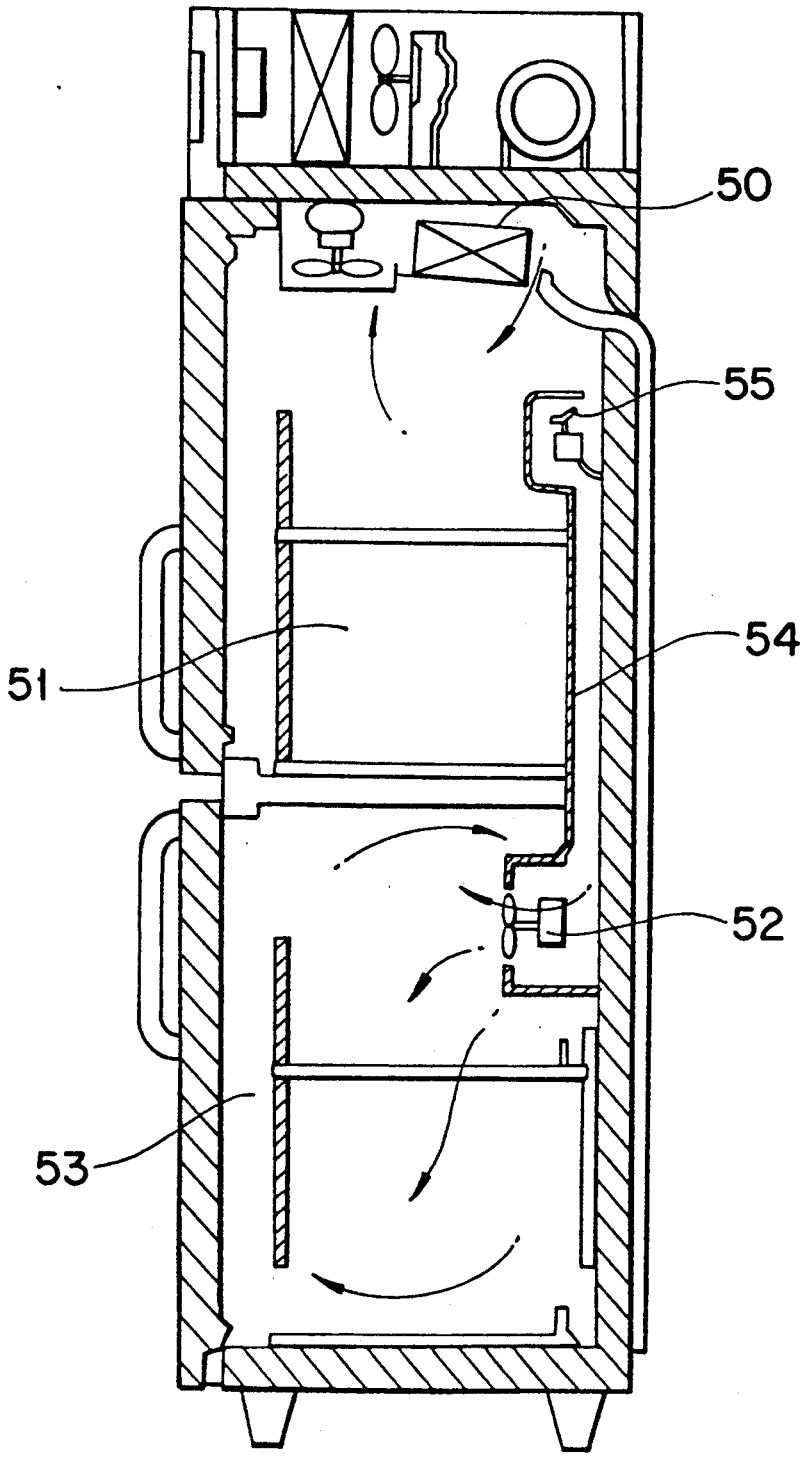
FIG. 2 (PRIOR ART)
Figure 3:
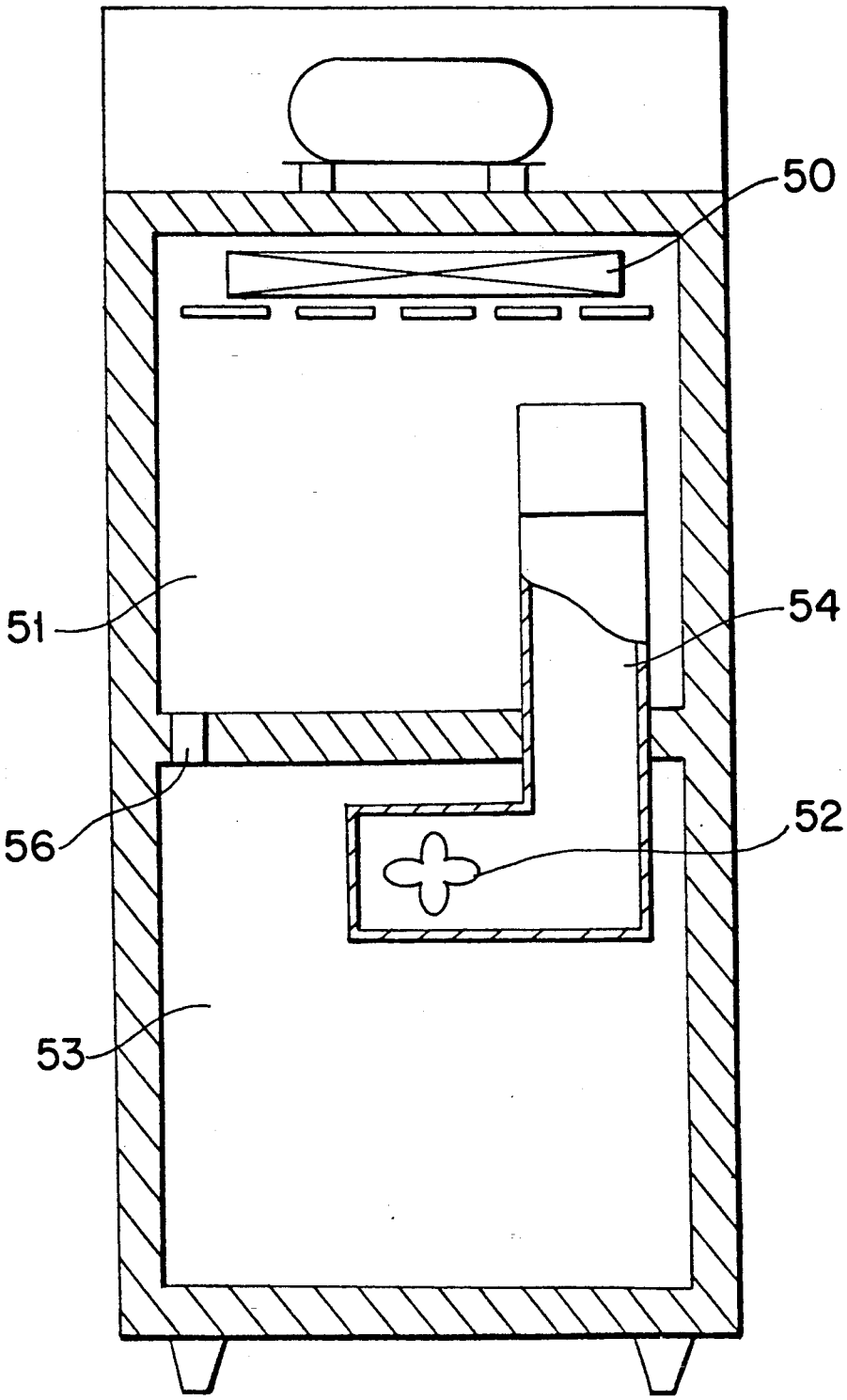
FIG. 3 (PRIOR ART)
Figure 4:
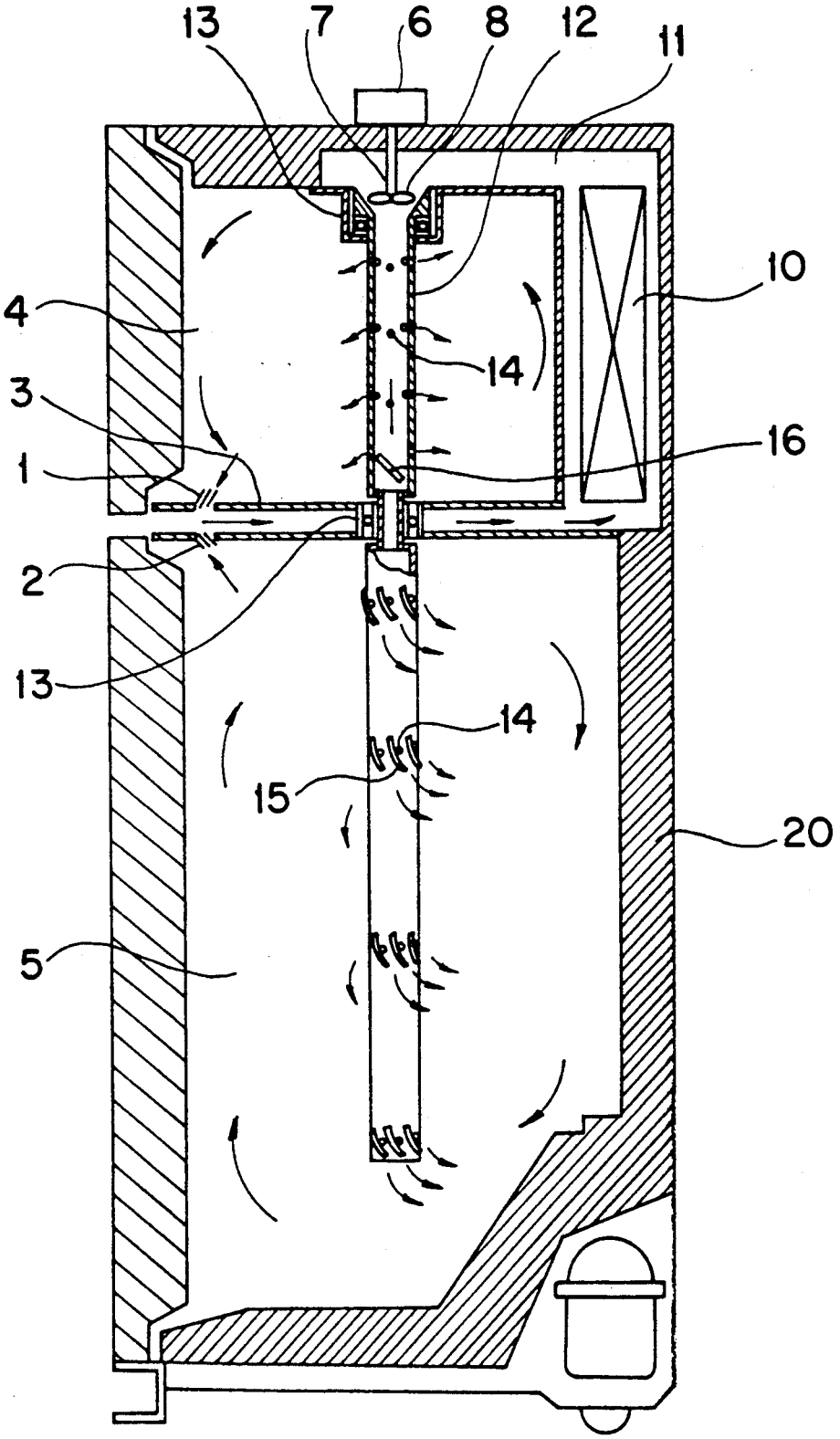

FIG. 4 is a longitudinal sectional view showing the cool air circulating apparatus according to the present invention, and here, reference numeral 20 indicates a body of the refrigerator surrounded by heat-insulating layers.

Within the refrigerator body 20, there is installed a chill suction member 3 in which chill suction holes 1 and 2 are formed on the upper and lower parts thereof. The chill suction member 3 separates a freezing room or chamber 4 and a refrigerating room or chamber 5 which are located up and down respectively.

A driving motor 6 is installed on the top of the body 20, and a shaft 7 of the driving motor 6 is connected to a cooling fan 8. An evaporator 10 for performing cooling cycles is installed on the rear of the freezing room, and the cool air produced by the evaporator is supplied through a chill path 11 into the upper portion of the freezing room 4.

Figure 5:
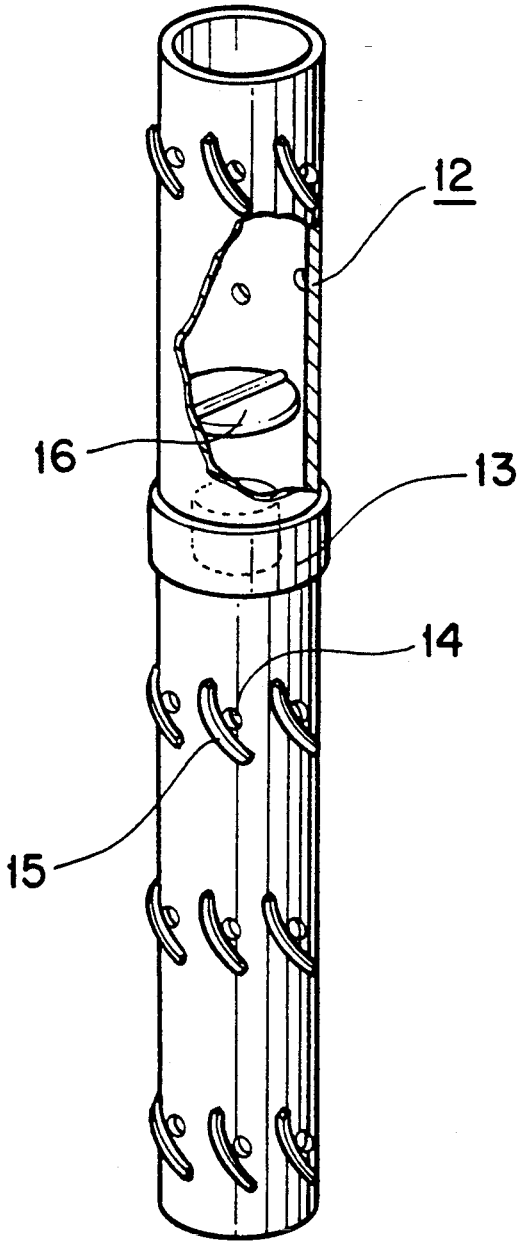

As shown in FIG. 5, the chill suction member 3 includes a bearing member 13 for retaining a rotary duct 12 which is installed in a freely rotating manner. The upper portion of the rotary duct 12 communicates with the end of the chill path 11 by being supported by a bearing member 13*a*, while the circumference of the rotary duct 12 is provided with a plurality of chill discharge holes 14. As shown in FIG. 6, a guide plate or fin 15 for guiding the discharged cool air is inclinedly and projectingly installed at a side of each of the chill discharge holes 14. The cool air produced by the evaporator 10 is supplied through the rotary duct 12 into both the freezing room 4 and the refrigerating room 5.

Figure 6:
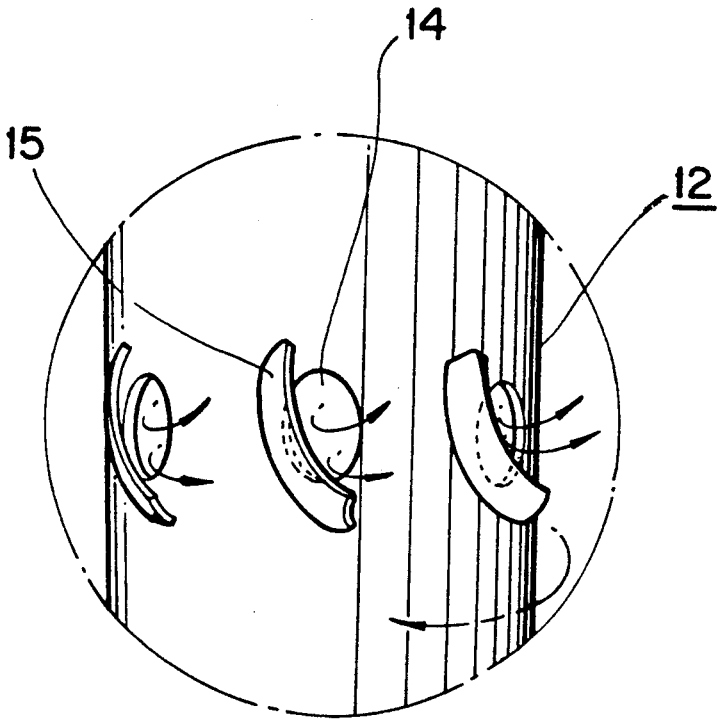

The rotary duct 12 produces revolving motions when the cool air discharged through the discharge holes 14 collides with the guide plates 15, and therefore, the rotation of the rotary duct 12 supplies the cool air in a uniform manner as shown in FIG. 6.

Within the rotary duct 12 near the bottom of the freezing room 4, there is pivotally installed a damper 16 for adjusting the flow of the cool air. The damper 16 is properly pivoted to pen and close the duct in accordance with the temperature of the refrigerating room 5, thereby controlling the temperature of the refrigerating room 5.

The cool air circulating apparatus of the present invention constituted as above will now be described as to its operation and effects.

First, the air near the evaporator 10 is cooled through the cooling cycle, and then, the cooled air is sent to the cool air path 11. Then the chill within the chill path 11 is supplied to the rotary duct 12 by the action of the cooling fan 8 which is driven by the driving motor 6.

The cool air within the rotary duct 12 is supplied downward by being forced by the cooling fan 8 of the driving motor 6, and then, the cool air is supplied through the chill discharge holes 14 into both the freezing room 4 and the refrigerating room 5.

The streams of the cool air which are discharged through the chill discharge holes collide with the guide plates 15, with the result that the rotary duct is driven rotatingly. Thus the rotary duct 12 revolves while being supported by the bearing members 13 and 13*a*, so that the cool air is spread uniformly through the interior of the refrigerator, thereby making the temperature distribution uniform.

Further, the opening degree of the damper 16 which is installed within the rotary duct 12 can be adjusted in accordance with the temperature of the refrigerating room 5, thereby controlling the temperature of the refrigerating room 5.

Meanwhile, the cool air stream which are discharged into both the freezing room 4 and the refrigerating room 5 are circulated in the direction of the arrows. Then they are sucked through the chill suction holes 1 and 2 into the chill suction member 3 and circulated toward the evaporator 10, this cycle being repeated.

According to the present invention as described above, the cool air is supplied through the rotary duct (which is rotated by the discharge of the chill) into both the freezing room 4 and the refrigerating room 5. The cool air is supplied uniformly through the interior of the refrigerator, and therefore, the temperature distribution is rendered uniform, as well as improving the cooling efficiency. Further the supply of the cool air is controlled by means of the damper which is installed within the rotary duct, thereby controlling the temperature of the refrigerator.

What is claimed is:

1. A refrigerator comprising:
a freezing chamber;
a refrigerating chamber;
means for producing cool air;
circulating means for circulating the cool air in said freezing and refrigerating chambers, comprising:
a hollow rotary duct extending substantially vertically through said freezing and refrigerating chambers and being rotatable about its longitudinal axis, said duct communicating with said cool air producing means and including a plurality of longitudinally spaced discharge holes for discharging the cool air into said freezing and refrigerating chambers, and
means for producing rotation of said duct about said longitudinal axis, comprising guide fins arranged at respective discharge holes such that the discharged cool air impinges against said guide fins to cause said duct to rotate.

2. A refrigerator according to claim 1, wherein said means for producing cool air disposed within a cool path arranged in said freezing chamber, said cool air path communicating with an upper end of said cut, a fan provided for forcing cool air downwardly through said duct.

3. A refrigerator according to claim 2 including a temperature-controlled damper disposed in said duct for controlling the amount of cool air supplied to those of said discharge holes which communicate with said refrigerating chamber.

4. A refrigerator according to claim 1 including a temperature-controlled damper disposed in said duct for controlling the amount of cool air supplied to those of said discharge holes which communicate with said refrigerating chamber.

5. A refrigerator comprising:
a food storage chamber;
means for producing cool air;
a hollow rotary duct extending vertically within said food storage chamber, said duct being freely rotatable about its longitudinal axis and communicating with said cool air producing means, a plurality of longitudinally spaced discharge holes formed in said duct for discharging cool air into said food storage chamber at different elevations; and
a plurality of guide fins arranged on said duct at said discharge holes such that the discharging cool air impinges against said guide fins to cause said duct to rotate.

6. A refrigerator comprising:
a freezing chamber;
a refrigerating chamber;
means for producing cool air;
circulating means for circulating the cool air in said freezing and refrigerating chamber, comprising:
a hollow rotary duct extending substantially vertically through said freezing and refrigerating chambers and being rotatable about its longitudinal axis, said duct communicating with said cool air producing means and including a plurality of longitudinally spaced discharge holes for discharging the cool air into said freezing and refrigerating chambers, means for producing rotation of said duct about said longitudinal axis, and a temperature-controlled damper disposed in said duct for controlling the amount of cool air supplied to those of said discharge holes which communicate with said refrigerating chamber.

7. A refrigerator comprising:

a freezing chamber;

a refrigerating chamber disposed beneath said freezing chamber and separated therefrom by a wall, means for producing cool air; and circulating means for circulating the cool air to said freezing and refrigerating chambers, comprising:

a hollow rotary duct extending downwardly through said freezing and refrigerating chambers and through said wall, said duct being rotatable about its vertical longitudinal axis and including upper and lower portions, said upper portion having an inlet end communicating with said cool air producing means for receiving cool air therefrom, said upper and lower portions each including a plurality of vertically spaced discharge holes for discharging the cool air into said freezing and refrigerating chambers at different elevations therein, blower means for forcing the cool air downwardly through said duct, valve means disposed between said upper and lower portions and being adjustable for varying the ratio of cool air discharged into said freezing and refrigerating chambers, and means for producing rotation of said duct about said vertical axis.

* * * * *